US008312926B2

(12) United States Patent
Wheeler

(10) Patent No.: US 8,312,926 B2
(45) Date of Patent: Nov. 20, 2012

(54) METHOD FOR REDUCING THERMAL LOSS IN A FORMATION

(75) Inventor: Thomas J. Wheeler, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 190 days.

(21) Appl. No.: 12/715,029

(22) Filed: Mar. 1, 2010

(65) Prior Publication Data

US 2010/0236778 A1 Sep. 23, 2010

Related U.S. Application Data

(60) Provisional application No. 61/160,909, filed on Mar. 17, 2009.

(51) Int. Cl.
*E21B 43/04* (2006.01)

(52) U.S. Cl. ..... 166/278

(58) Field of Classification Search ..... None
See application file for complete search history.

(56) References Cited

U.S. PATENT DOCUMENTS

| | | | | |
|---|---|---|---|---|
| 3,669,188 | A * | 6/1972 | Coles et al. | 166/270 |
| 4,074,757 | A * | 2/1978 | Felber et al. | 166/261 |
| 4,431,055 | A * | 2/1984 | Parrish | 166/250.15 |
| 4,444,261 | A * | 4/1984 | Islip | 166/272.4 |
| 4,793,415 | A * | 12/1988 | Holmes et al. | 166/270 |
| 2010/0096126 | A1 * | 4/2010 | Sullivan et al. | 166/260 |

* cited by examiner

*Primary Examiner* — Shane Bomar
*Assistant Examiner* — Silvana Runyan
(74) *Attorney, Agent, or Firm* — ConocoPhillips Company

(57) ABSTRACT

A method for reducing thermal loss in a formation comprising two zone capable of production. The method first begins drilling a pair of wells, comprising a first well and a second well in a formation having two production zones, wherein one production zone is a thief zone such that the first well and the second well are in fluid communication with the thief zone. A sealing agent is injected into the thief zone via a first well and produced from the second well. Either the first well or the second well is then capped to form a capped well and a uncapped well. An amount of activating agent is injected into the uncapped well to form in-situ a thermally restrictive substance inside the thief zone.

5 Claims, 6 Drawing Sheets

METHOD FOR REDUCING THERMAL LOSS IN A FORMATION

CROSS-REFERENCE TO RELATED APPLICATIONS

None

STATEMENT REGARDING FEDERALLY SPONSORED RESEARCH OR DEVELOPMENT

None

FIELD OF THE INVENTION

A method for reducing thermal loss in a formation by creating a thermally restrictive substance in-situ.

BACKGROUND OF THE INVENTION

Heavy oil is any type of crude oil that does not flow easily. Heavy oil is typically defined as crude oil having a viscosity of greater than 100 cp, or a gravity of less than 22° API. Heavy oil can be classified into three categories: 1) heavy oil having a viscosity less than 10,000 cp and a gravity between 10° and 22° API; 2) extra-heavy oil having a viscosity less than 10,000 cp and a gravity less than 10° API; and 3) bitumen having a viscosity greater than 10,000 cp, regardless of gravity. These heavy oils usually require some form of enhanced oil recovery, typically the addition of heat and or solvent to the reservoir, in order to recover the oil.

In order to recover these heavy oils, wells are usually drilled through formations that contain earth layers that may consists of different permeabilities, and/or porosities and/or saturations. These wells are often lined with casing and cement that have completions, allowing communication with these intervals, open along part of the well. Preferably, the fluid flow rate into and out of each layer (interval) should be about equal. If the permeability or water saturation of one layer (interval) is anomalously high, then fluid flow rate and/or energy flow rate in that layer is higher than in the other layers. Such a high permeability layer is called a "thief zone", due to the energy/fluid lost in this area. These thief zones detrimentally affect the production rate from the recovery of heavy oils by stealing the energy added to heat the heavy oil One of the best ways to seal the thief zones involves in-situ sealing deep inside the formation. Silva et al.'s mathematical model ("Waterflood Performance in the Presence of Stratification and Formation Plugging," SPE Paper No. 3556, 46th SPE Annual Meeting, New Orleans, Oct. 3 through 6, 1971) showed that sealing a thief zone at the wellbore was not enough. When the thief zone is sealed only near the wellbore, the flow behavior continued just beyond the sealed region as if no sealing had occurred. Unfortunately, most known methods tend to seal the thief zones only near the wellbore.

Another commonly utilized technique is to cause an in-situ change of the injection fluid in order to deeply penetrate the thief zone before sealing takes place. Two such commercial methods are now being used. One method is in-situ polymerization of carefully spaced slugs of monomer and catalyst. In theory, mixing these slugs deep inside the formation produces the desired polymer matrix and seals the thief zone. However, given the complexity of flow behaviors of slugs in a heterogeneous formation, it is difficult to place the polymer matrix where desired. Furthermore, if the slugs are not properly placed it is difficult to ensure that the entire thief zone is sealed off. The other method is time-delayed gelling of polymers. But the delay time may only be a few days (e.g., 48 to 72 hours for xanthan gum by chromium ions). Such short times prevent a deep penetration of the sealing fluid into the thief zone.

Techniques have also been designed to capitalize upon the heat added to enhance the oil recovery. U.S. Pat. No. 3,669,188 teaches using a plugging fluid that reacts to deposit a plugging material as temperature increases. The thief zone near the well is heated so that it is hotter than the surrounding regions, then the plugging fluid is injected into that zone, and then unreacted plugging fluid is displaced after plugging has occurred. Preferably, the plugging fluid is an aqueous solution of a metal and a reactant. The metal precipitates as a gelatinous metal hydroxide and the reactant increases the solution pH to cause that precipitation. Preferably, slugs of hot water are used to heat the thief zone. This injected hot water, however, may lose a substantial amount of energy, making the process less effective deep inside the thief zone, where plugging is needed the most. Basically, this method was designed to apply in the "near well" region (less than twenty feet from the wellbore).

Other techniques have been designed to incorporate secondary heating sources utilized specifically to heat plugging material in the thief zone. U.S. Pat. No. 3,620,302 teaches plugging thief zones with an inorganic silicate. An aqueous solution of the silicate is injected into the thief zones, in-situ combustion is generated in a nearby zone, and that combustion is sustained until enough heat is transferred to the thief zones to cause the silicate to intumesce and seal the thief zones. Unfortunately, such in-situ combustion cannot be used in most fields.

To combat the problems associated with in-situ sealing of the thief zone, techniques have been designed to incorporate electrical currents to seal the thief zones. U.S. Pat. No. 4,809,780 teaches a method of plugging the thief zone that involves in-situ transformation of the thief zone. The in-situ transformation is performed by inducing electrical resistance through a saline solution that is injected through the injection well. However use of in-situ electrical transformation of the saline solution to seal thief zones cannot be utilized for tar sands because the electrical current is confined to the narrow path of least resistance and accordingly cannot completely seal the thief zone.

There exists a need for a method able to restrict heat loss over large areas of thief zones that is applicable over different types of strata.

SUMMARY OF THE INVENTION

The present embodiment depicts a method for reducing thermal loss in a formation comprising two production zones in a steam assisted gravity drainage operation. The method first begins drilling a pair of wells, comprising a first well and a second well in a formation having two production zones, wherein one production zone is a thief zone such that the first well and the second well are in fluid communication with the thief zone. A sealing agent is injected into the thief zone via a first well and produced from the second well. Either the first well or the second well is then capped to form a capped well and a uncapped well. An amount of activating agent is injected into the uncapped well to form in-situ a thermally restrictive substance inside the thief zone.

The present embodiment also depicts a method for recovering hydrocarbons in a formation comprising a heat thief and a production zone. The process begins with sealing a heat thief, in a formation that composes two production zones.

A pair of wells are drilled to the depth of the primary stratum, wherein the pair of wells comprise a first well and a second well. The method then injects into the first well a sealing agent till the second well produces the sealing agent. One of the two wells is then capped off to produce a capped well and an uncapped well. This is followed by injecting into the uncapped well an amount of a activating agent as required to form in-situ a thermally restrictive substance inside the thief zone stratum.

After the thief zone is sealed the hydrocarbons in the non-aqueous stratum are heated to a desired temperature to promote hydrocarbon flow. Heated hydrocarbons are then produced through an oil well.

BRIEF DESCRIPTION OF THE DRAWINGS

The invention, together with further advantages thereof, may best be understood by reference to the following description taken in conjunction with the accompanying drawings.

DETAILED DESCRIPTION OF THE INVENTION

Figure 1:
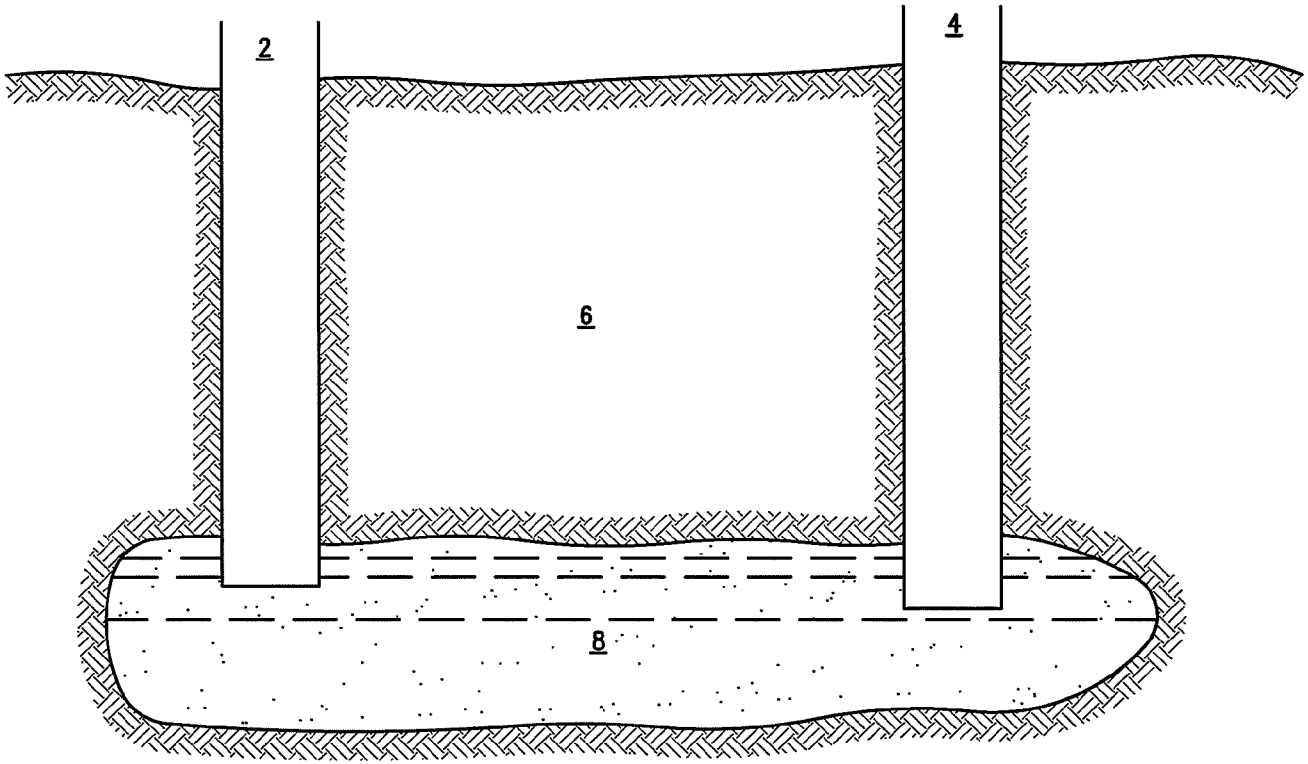
FIG. 1 depicts a pair of disposable wells drilled to the depth of the heat thief.

The present method involves a method for reducing thermal loss in a formation by forming in-situ a thermally restrictive substance. The thermally restrictive substance is able to reduce thermal loss primarily through convective heat transfer reduction however other heat loss reduction methods such as conductive heat transfer reduction are achieved though this method as well.

The present method is able to reduce thermal loss in formations that include at least two zones capable of production that have different levels of fluid permeability. Examples of formations that this method is capable of operating in include but are not limited to claustic or carbonate formations.

In one embodiment the method is utilized in a thermal production operation. One example of a thermal production operation is a steam assisted gravity drainage system.

In one embodiment a reduction of thermal loss in a formation wherein one production zone is a thief zone can be achieved through the following method. Initially a pair of wells, comprising a first well and a second well are drilled into a formation having two are more production zones. It is essential that one of the production zones is classified a thief zone and that the pair of wells are in fluid communication with the thief zone. A sealing agent is then injected into the first well. From this point forward one of pair wells is capped to form a capped well and an uncapped well. A sufficient amount of an activating agent is then injected into the uncapped well till a thermally restrictive substance is formed in-situ inside the thief zone. The final optional step in reducing the thermal loss in the formation ends with capping the uncapped well.

The capping of one of the pair of wells can be done by any method commonly known in the field. Examples of conventional methods of capping a well include use of cement plugs or bridge plugs.

The selection of the sealing agent and the solution are chosen by one skilled in the art to ensure that a thermally restrictive substance is formed within the thief zone. The thermally restrictive substance should be able to restrict or prevent the circulation of fluids thereby preventing energy loss through convective heat loss.

Examples of thermally restrictive substances that can be formed from the sealing agent and the solution include but are not limited to gels, foams, silica, acrylates, polymers, resins and epoxy's commonly known in the art. Examples of sealing agents and activating agents that can be injected into the disposable wells include those commonly known in the art, for example, but are not limited to active magnesium oxide and dicalcium phosphate or combinations of silica, alkali and polyvalent metal ions. Preferably the sealing agent is injected into the thief zone until the second well produces the sealing agent.

Although it is possible in one embodiment that the pair of wells be reused in any in any manner commonly known in the art, it is also permissible in an alternate embodiment that the pair of wells are reused as injection and production wells.

The method of reducing thermal loss in a formation can also be combined with a process for recovering hydrocarbons in a formation via a steam assisted gravity drainage process. Using such a process the heat thief in the formation is first sealed. Sealing of the heat thief is accomplished by reducing the fluid mobility of the stratum. The sealing occurs by drilling a pair of wells comprising a first well and a second well. A sealing agent is then injected into the first well till the second well produces the sealing agent. This is followed by capping one of the pair of wells. A sealing agent is the injected into the uncapped well to form in-situ a thermally restrictive substance inside the thief zone followed by an optional step of capping the agent forming injection well. To promote hydrocarbon flow, the hydrocarbons are then heated using conventionally known heating methods. An oil well is then able to produce the heated hydrocarbons through an oil well. The oil well can be drilled before, during or after the drilling of the two disposable wells.

In a preferred embodiment the use of this method to reduce thermal loss in a formation is performed in combination with steam assisted gravity drainage. When employed at the same time as steam assisted gravity drainage, multiple pairs of wells can be engaged to either simultaneous or consecutively reduce thermal loss in formations forcing the steam to heat the heavy crude oil or bitumen reducing the viscosity allowing production at an enhanced rate.

One embodiment of the invention is illustrated in FIG. 1. A pair wells, a first well 2 and a second well 4, are shown to penetrate the production zone 6. The first well 2 and the second well 4 can be drilled either simultaneously or independent of each other and are drilled to the depth of the thief zone 8. It is important to note that selection of the first well 2 and the second well 4 are interchangeable.

Figure 2:
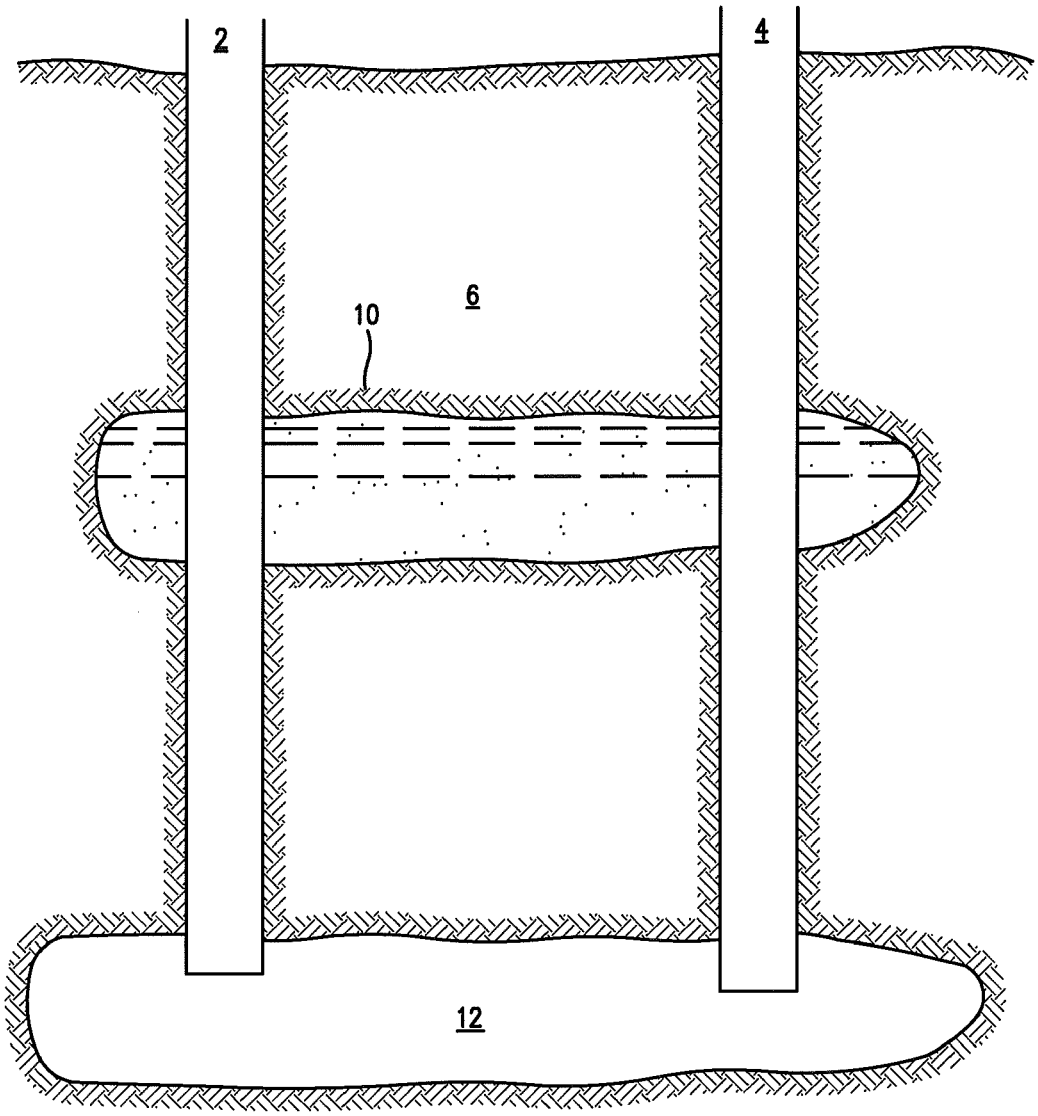
FIG. 2 depicts a pair of disposable wells utilized to prevent thermal loss in two production zones.

FIG. 2 depicts an embodiment wherein the pair of wells are utilized to reduce thermal loss in two thief zones, a first thief zone 10 and a second thief zone 12. In this embodiment the operator would initially drill the pair of wells to the depth of the first thief zone 10 then inject the sealing agent followed by the activating agent to produce a first thermally restrictive substance. Subsequently, the depth of the first well 2 and the second well 4 can be extended to the second thief zone 12. The steps of injecting the sealing agent followed by the solution can continue with the second thief zone till a second thermally restrictive substance is created. The ability to form multiple thermal restrictive substances within a formation is particularly useful and novel when the formation is composed of multiple aqueous strata's which would operate as multiple heat thief zones.

Figure 3:
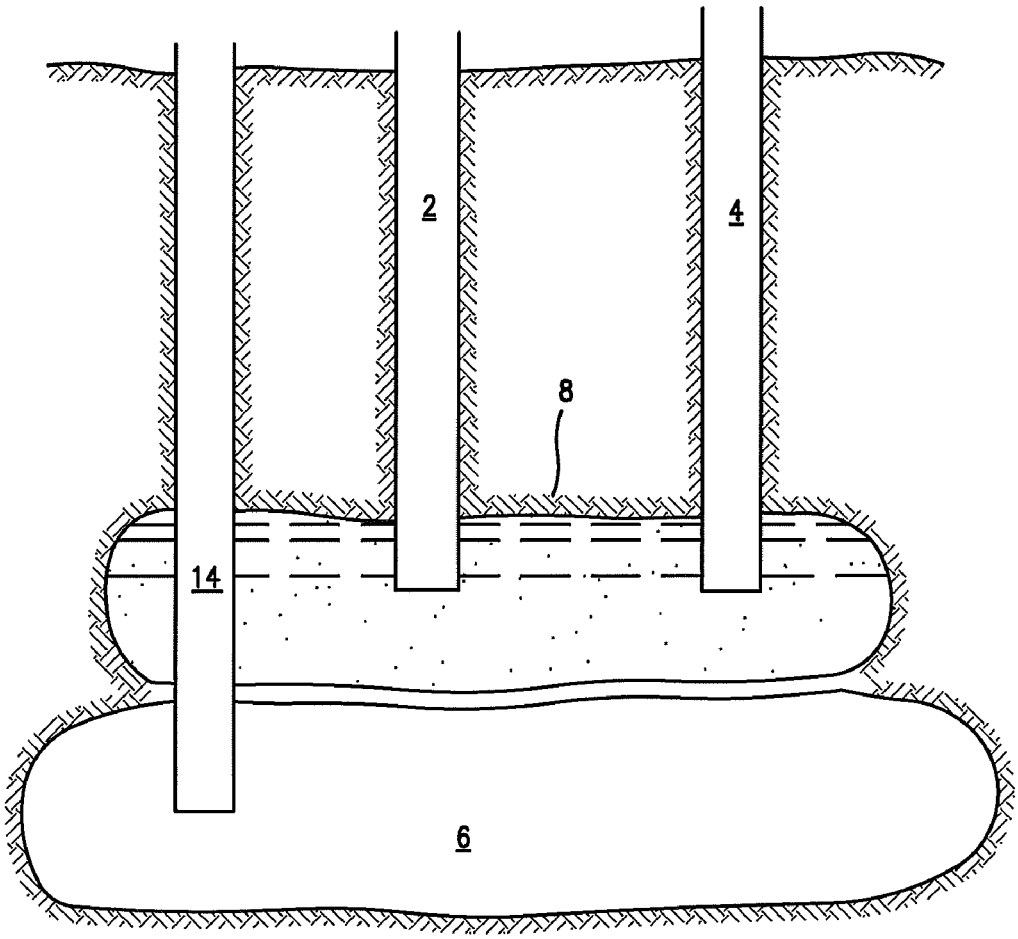
FIG. 3 depicts producing oil from an oil well that is in formation with a heat thief.

FIG. 3 depicts an embodiment wherein the pair wells have been used to create the thermally restrictive substance inside the thief zone 8. An oil well 14 is then used to produce the crude oil from the production zone 6. Different in-situ techniques can be utilized to extract the oil from the production zone 6; these techniques include but are not limited to: cold flow, cyclic steam stimulation, steam assisted gravity drainage, vapor extraction process or toe to heel air injection or hybrids of any of these processes. In each of these methods the thermally restrictive substance inside the thief zone 8 is used to restrict or prevent the circulation of fluids and energy loss in the region, but also used to reduce heat loss or gain with these methods.

Figure 4:
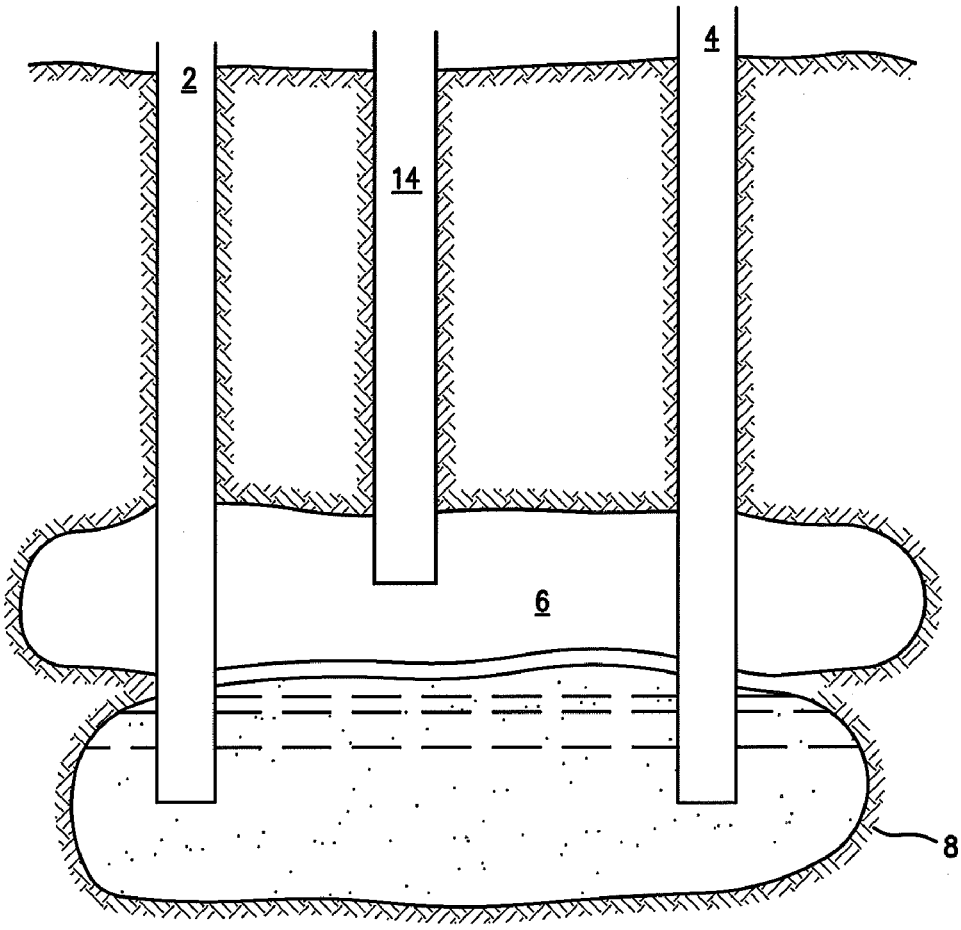
FIG. 4 depicts producing oil from an oil well that is formation with a heat thief.

FIG. 4 depicts an alternate embodiment of FIG. 3, where the thief zone 8 is now situated above the production zone 6. The thief zone 8 can be located either above, below or to the side of the production zone 6. The only requirement is that the thermally restrictive substance created inside the thief zone 8 is used to heat thief when the oil well 14 is producing from the production zone 6.

Figure 5:
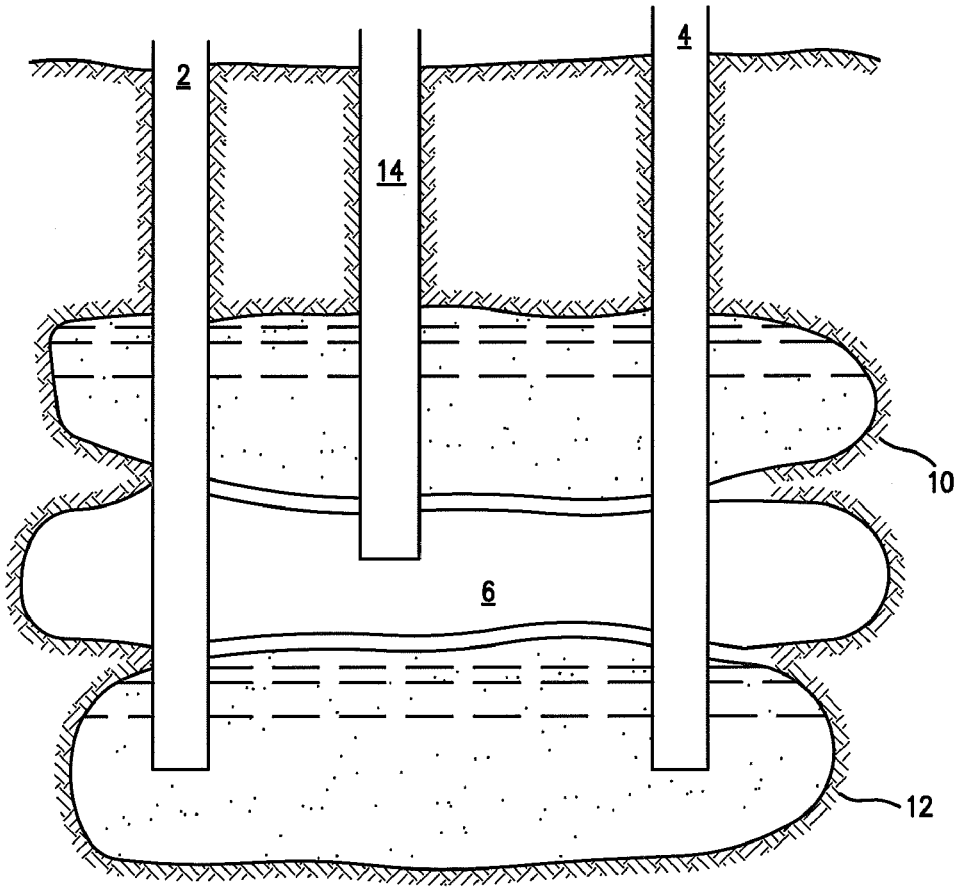
FIG. 5 depicts producing oil from an oil well that is in formation with more than one heat thief.

FIG. 5 depicts an embodiment where the first thief zone 10 and the second thief zone 12 surround the production zone 6. In such an embodiment the oil well 14 can be enticed to produce through different in-situ techniques either before or after the thermally restrictive substance is created in the second thief zone 12. Such an embodiment depicts the multitude of ways the thermally restrictive substance can be used to prevent heat loss in a formation.

Figure 6:
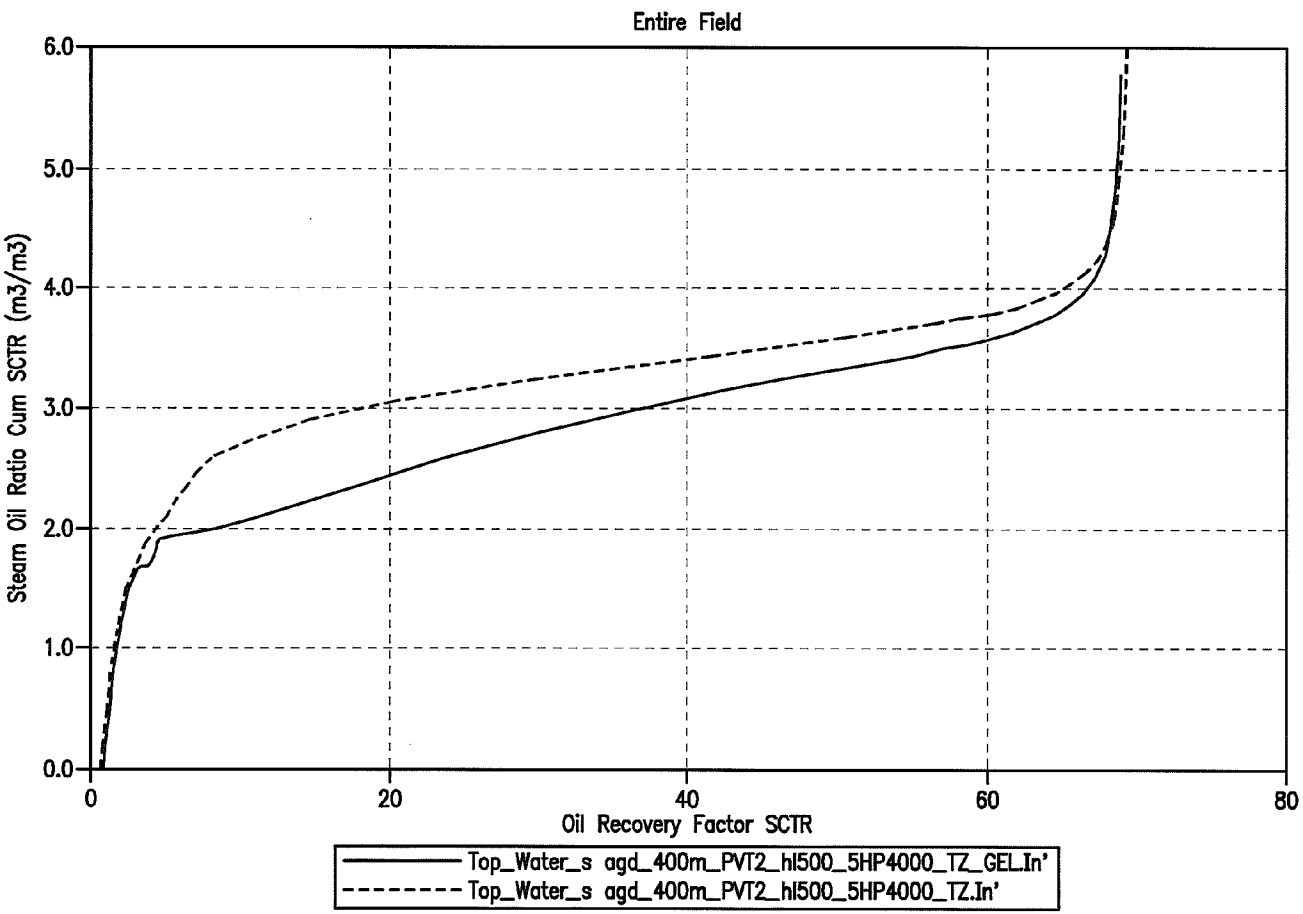
FIG. 6 depicts the expected gain in economic recovery when preventing heat loss in a formation.

FIG. 6 depicts one of the expected benefits of using the method to reduce thermal loss in a formation. By reducing the heat transfer in an aqueous high water saturation stratum recovery of the crude oil can be achieved with a lower cumulative steam-oil ratio. Using the current method a cumulative steam-oil ratio less than 3.0 can be achieved. This lower cumulative steam-oil ratio is particularly influential when applied to steam assisted gravity drainage and thermal projects. The solidification of the aqueous interval reflects a reduction in the thermal conductivity of the strata, as well as an overall reduction in the permeability/porosity of the strata, due to the solidification of the stratum. FIG. 6 depicts in a steam assisted gravity drainage system economic recovery is increased from about 16% to about 37% by reducing the heat transfer to an adjacent stratum of non-hydrocarboneous fluid.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described herein. It is the intent of the inventors that variations and equivalents of the invention are within the scope of the claims below and the description, abstract and drawings are not to be used to limit the scope of the invention.

The invention claimed is:

1. A method of reducing thermal loss comprising the steps of:

drilling a pair of wells comprising a first well and a second well in a formation having two production zones, wherein one production zone is a thief zone such that the first well and the second well are in fluid communication with the thief zone;

injecting a sealing agent into the thief zone via a first well and producing the sealing agent from the second well;

capping either the first well or the second well to form a capped well and an uncapped well; and injecting into the uncapped well an amount of an activating agent to form in-situ a thermally restrictive substance inside the thief zone, the thermally restricted substance extending from the uncapped well to the capped well through the thief zone;

wherein the method is operated in conjunction with steam assisted gravity drainage.

2. The method of claim 1, wherein the formation is subject to a thermal production operation.

3. The method of claim 1, wherein the thermal loss reduced is convective heat transfer.

4. The method of claim 1, wherein the injection of the sealing agent is stopped when the agent producing well produces the sealing agent.

5. A process of reducing thermal loss comprising:

a. sealing a thief zone, wherein the sealing comprises the steps of:

drilling a pair of wells comprising a first well and a second well in a formation having two production zones, wherein one production zone is the thief zone such that the first well and the second well are in fluid communication with the thief zone;

injecting a sealing agent into the thief zone via a first well and producing the sealing agent from the second well;

capping either the first well or the second well to form a capped well and a uncapped well; and injecting into the uncapped well an amount of an activating agent to form in-situ a thermally restrictive substance inside the thief zone the thermally restricted substance extending from the uncapped well to the capped well through the thief zone;

b. heating the hydrocarbons in at least one production zone to a desired temperature to promote hydrocarbon flow; and c. producing the heated hydrocarbons through an oil well with steam assisted gravity drainage.

* * * * *